US011098600B2

(12) United States Patent
Morisawa et al.

(10) Patent No.: US 11,098,600 B2
(45) Date of Patent: Aug. 24, 2021

(54) TRANSITION PIECE

(71) Applicant: TOSHIBA ENERGY SYSTEMS & SOLUTIONS CORPORATION, Kawasaki (JP)

(72) Inventors: Yuichi Morisawa, Yokohama (JP); Hideyuki Maeda, Yokohama (JP); Takahiro Nakanishi, Yokohama (JP); Masao Itoh, Yokohama (JP); Yasunori Iwai, Yokohama (JP)

(73) Assignee: TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 161 days.

(21) Appl. No.: 16/571,843

(22) Filed: Sep. 16, 2019

(65) Prior Publication Data

US 2020/0141253 A1 May 7, 2020

Related U.S. Application Data

(63) Continuation of application No. PCT/JP2017/010665, filed on Mar. 16, 2017.

(51) Int. Cl.
*F01D 9/02* (2006.01)
*F23R 3/60* (2006.01)
(Continued)

(52) U.S. Cl.
CPC ..... *F01D 9/023* (2013.01); *F23R 3/60* (2013.01); *F05D 2260/96* (2013.01);
(Continued)

(58) Field of Classification Search
CPC .. F01D 9/023; F23R 3/002; F23R 3/60; F23R 3/46; F23R 2900/03041;
(Continued)

(56) References Cited

U.S. PATENT DOCUMENTS 7,743,613 B2 * 6/2010 Lee ..... F01D 9/065 60/782
7,930,891 B1 * 4/2011 Brostmeyer ..... F01D 9/023 60/796
9,335,051 B2 * 5/2016 Jarmon ..... F23R 3/005

FOREIGN PATENT DOCUMENTS

CN 104235879 A 12/2014
EP 2 028 344 A1 2/2009
(Continued)

OTHER PUBLICATIONS

International Search Report dated May 30, 2017 in PCT/JP2017/010665 filed Mar. 16, 2017 (with English Translation).
(Continued)

*Primary Examiner* — Todd E Manahan
*Assistant Examiner* — Todd N Jordan
(74) *Attorney, Agent, or Firm* — Oblon, McClelland, Maier & Neustadt, L.L.P.

(57) ABSTRACT

A transition piece of an embodiment leads a combustion gas generated by a combustor liner to a turbine part in a gas turbine facility. An outlet portion from which the combustion gas flows out to the turbine part in the transition piece includes: an inner peripheral wall located inside in a radial direction of the turbine part; an outer peripheral wall located further outside than the inner peripheral wall in the radial direction; and support struts provided between the inner peripheral wall and the outer peripheral wall. In the inner peripheral wall, first insertion grooves are formed. In the outer peripheral wall, second insertion grooves are formed. In the support struts, first end portions located inside in the radial direction are inserted into and fixed in the first insertion grooves, and second end portions located outside in the radial direction are inserted into and fixed in the second insertion grooves.

2 Claims, 8 Drawing Sheets

(51) Int. Cl.
*F23R 3/00* (2006.01)
*F23R 3/46* (2006.01)

(52) U.S. Cl.
CPC ..... *F23R 3/002* (2013.01); *F23R 3/46* (2013.01); *F23R 2900/03042* (2013.01)

(58) Field of Classification Search
CPC .. F23R 2900/03042; F23R 2900/03043; F23R 2900/03044; F05D 2260/202
See application file for complete search history.

(56) References Cited

FOREIGN PATENT DOCUMENTS

| | | |
|---|---|---|
| JP | 1-125525 A | 5/1989 |
| JP | 1-155120 A | 6/1989 |

OTHER PUBLICATIONS

Written Opinion dated May 30, 2017 in PCT/JP2017/010665 filed Mar. 16, 2017.

* cited by examiner

TRANSITION PIECE

CROSS REFERENCE TO RELATED APPLICATIONS

The present application is a continuation application of International Application No. PCT/JP2017/010665, filed Mar. 16, 2017. The contents of this application are incorporated herein by reference in their entirety.

FIELD

Embodiments of the present invention relate to a transition piece.

BACKGROUND

In a gas turbine power plant, a compressor is provided coaxially with a turbine part, and a compressed medium (compressed air) compressed in the compressor is guided with fuel into a combustor. Then, in the combustor, combustion occurs in a combustor liner, thereby generating a high-temperature combustion gas. The combustion gas is introduced as a working medium through a transition piece to the turbine part. This makes the combustion gas expand in the turbine part to rotate a turbine rotor, thereby generating electricity. In the gas turbine power plant, the larger a pressure ratio (outlet pressure/inlet pressure) between an outlet pressure and an inlet pressure of the compressor is, the more power generation efficiency is improved. For this reason, the outlet pressure of the compressor is promoted to increase the pressure.

A transition piece 20J will be explained by using FIG. 6.

In the transition piece 20J, a portion on an inlet side 20A into which a combustion gas flows is a cylindrical tubular body, and a portion on an outlet side 20B from which the combustion gas flows out is a fan-shaped tubular body.

On the transition piece 20J, a pressure of a medium for combustion ejected from the compressor acts from the outside thereof, and a pressure of the combustion gas introduced from the combustor liner acts from the inside thereof. Because the pressure of the medium for combustion which acts from the outside thereof and the pressure of the combustion gas which acts from the inside thereof differ from each other, in the transition piece 20J, a pressure difference occurs between the outside and the inside thereof. This makes a pressure act uniformly in a portion on the inlet side 20A having a cylindrical shape, but makes the action of pressure non-uniform in a portion on the outlet side 20B having a fan shape, in the transition piece 20J. As a result, in the portion on the outlet side 20B, as indicated by a dot and dash line in FIG. 6, deformation is likely to occur as an outer peripheral side (an upper side portion in FIG. 6) and an inner peripheral side (a lower side portion) come close to each other.

Further, in the transition piece 20J, an area of a gas flow path on the outlet side 20B is smaller than an area of a gas flow path on the inlet side 20A. This causes the portion on the outlet side 20B to be exposed to under a high-temperature environment due to a rise in metal temperature, and therefore creep deformation is likely to remarkably occur. The creep deformation occurs by using the transition piece 20J continuously, thereby making an inner diameter of the portion on the outlet side 20B small in some cases. This sometimes makes an increase in damage, a power reduction, and an efficiency reduction occur.

For this reason, in the transition piece 20J, a technique for preventing the above-described deformation has been proposed. For example, in order to prevent deformation in the outlet portion of the transition piece 20J, it is proposed that one support strut is disposed in the middle of the path in the outlet portion. Here, the support strut is integrally joined to each of an inner peripheral wall and an outer peripheral wall of the transition piece by welding (for example, Patent Document 1).

As described above, the support strut is integrally joined to each of the inner peripheral wall and the outer peripheral wall of the transition piece by welding. A temperature of a combustion gas flowing inside the transition piece is very high. For this reason, at fixed portions fixing the support strut in the transition piece, a large thermal stress is generated to sometimes cause breakage. Further, since the support strut is joined by welding, the support strut cannot be easily disassembled from the transition piece, which therefore makes an exchange of the support strut difficult.

Accordingly, the problem to be solved by the present invention is to provide a transition piece being capable of suppressing generation of a large thermal stress at the fixed positions of the support strut and allowing the exchange of the support strut to be easily achieved.

DETAILED DESCRIPTION

A transition piece of an embodiment leads a combustion gas to a turbine part in a gas turbine facility. An outlet portion from which the combustion gas flows out to the turbine part in the transition piece includes: an inner peripheral wall located inside in a radial direction of the turbine part; an outer peripheral wall located further outside than the inner peripheral wall in the radial direction; and support struts provided between the inner peripheral wall and the outer peripheral wall. In the inner peripheral wall, first insertion grooves are formed. In the outer peripheral wall, second insertion grooves are formed. In the support struts, first end portions located inside in the radial direction are inserted into and fixed in the first insertion grooves, and second end portions located outside in the radial direction are inserted into and fixed in the second insertion grooves.

First Embodiment

Figure 1:
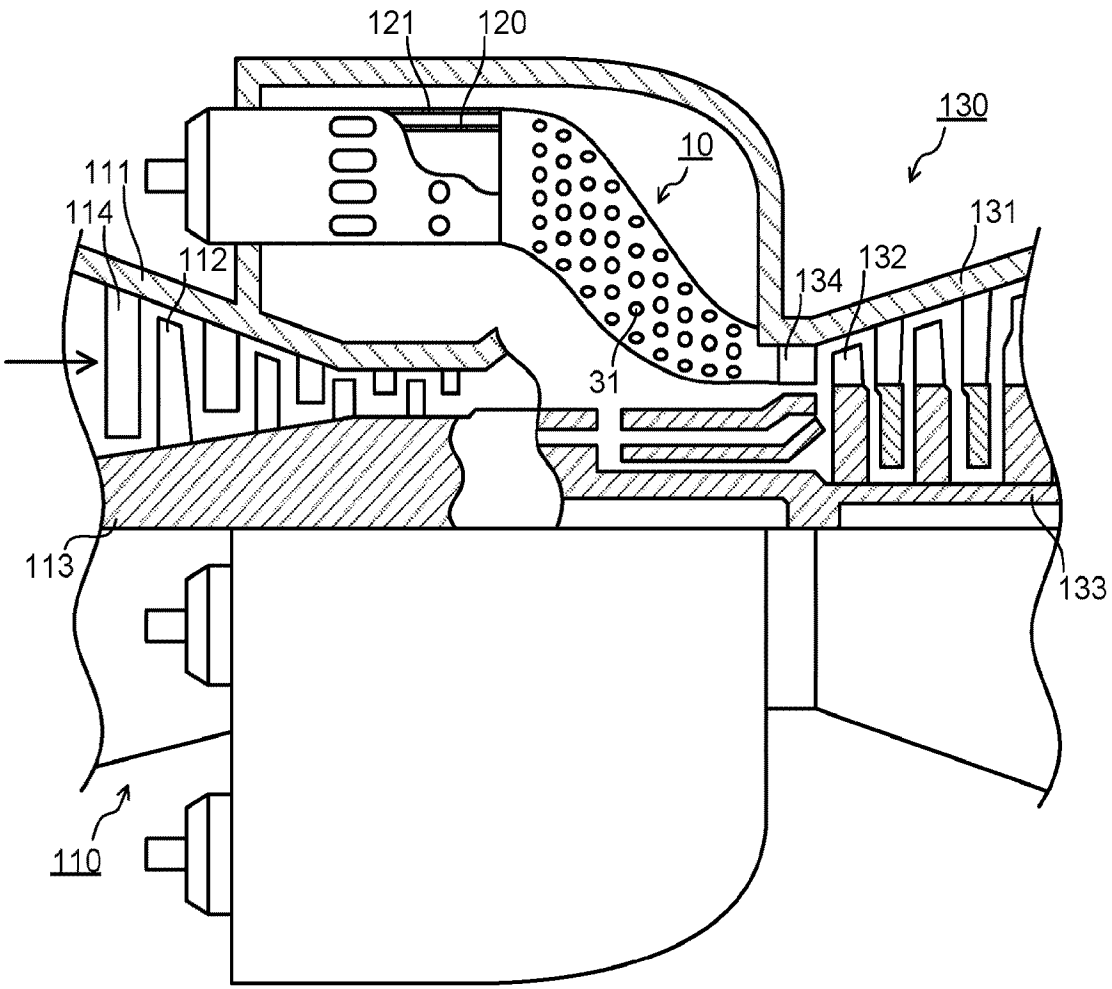
FIG. 1 is a partially sectional view schematically illustrating a substantial part of a gas turbine facility 100 according to a first embodiment.

A gas turbine facility 100 according to a first embodiment will be exemplified by using FIG. 1. In FIG. 1, a lateral direction corresponds to an axial direction (thrust direction) along a rotation axis, and a vertical direction corresponds to a part of a radial direction orthogonal to the rotation axis.

As illustrated in FIG. 1, the gas turbine facility 100 includes a compressor 110 which compresses outside air, a combustor liner 120 which mixes air compressed by the compressor 110 and fuel to combust the mixture, a transition piece part 10 which leads a combustion gas generated by the combustor liner 120 to a turbine part 130, and the turbine part 130 which is driven by the combustion gas which has passed through the transition piece part 10 flowing thereinto as a working medium.

The compressor 110 includes a compressor rotor 113 inside a compressor casing 111. The compressor rotor 113 includes a rotor blade cascade in which a plurality of rotor blades 112 are disposed in a circumferential direction, and a plurality of the rotor blade cascades are arranged in the axial direction. The compressor casing 111 includes a stationary blade cascade in which a plurality of stationary blades 114 are disposed in the circumferential direction, and a plurality of the stationary blade cascades are arranged in the axial direction. Here, the plurality of rotor blade cascades and the plurality of stationary blade cascades are provided so as to be arranged alternately in the axial direction. In the compressor 110, the rotor blades 112 rotate with the compressor rotor 113, thereby compressing the outside air.

A plurality of the combustor liners 120 are disposed in the circumferential direction in the circumference of the compressor 110. In the combustor liner 120, the fuel and the air compressed by the compressor 110 are mixed to be combusted, thereby generating the combustion gas.

The transition piece part 10 is connected to the combustor liner 120. The transition piece part 10 is constructed so that the combustion gas flows from the combustor liner 120 into the transition piece part 10 and the combustion gas is flow-straightened to be directed to the turbine part 130. Details on the transition piece part 10 will be described later.

The turbine part 130 includes a turbine rotor 133 inside a turbine casing 131. The turbine rotor 133 includes a rotor blade cascade in which a plurality of rotor blades 132 are disposed in the circumferential direction, and a plurality of the rotor blade cascades are arranged in the axial direction. The turbine casing 131 includes a stationary blade cascade in which a plurality of stationary blades 134 are disposed in the circumferential direction, and a plurality of the stationary blade cascades are arranged in the axial direction. Here, the plurality of rotor blade cascades and the plurality of stationary blade cascades are provided so as to be arranged alternately in the axial direction. That is, a plurality of turbine stages including the stationary blade cascades and the rotor blade cascades are arranged along the rotation axis. The combustion gas introduced from the transition piece part 10 to the turbine part 130 is injected through the stationary blades 134 to the rotor blades 132. This rotates the rotor blades 132 and the turbine rotor 133 in the turbine part 130. To the turbine rotor 133, a generator (whose illustration is omitted) is coupled, and rotational energy of the turbine rotor 133 is transformed into electric energy by the generator.

Figure 2A:
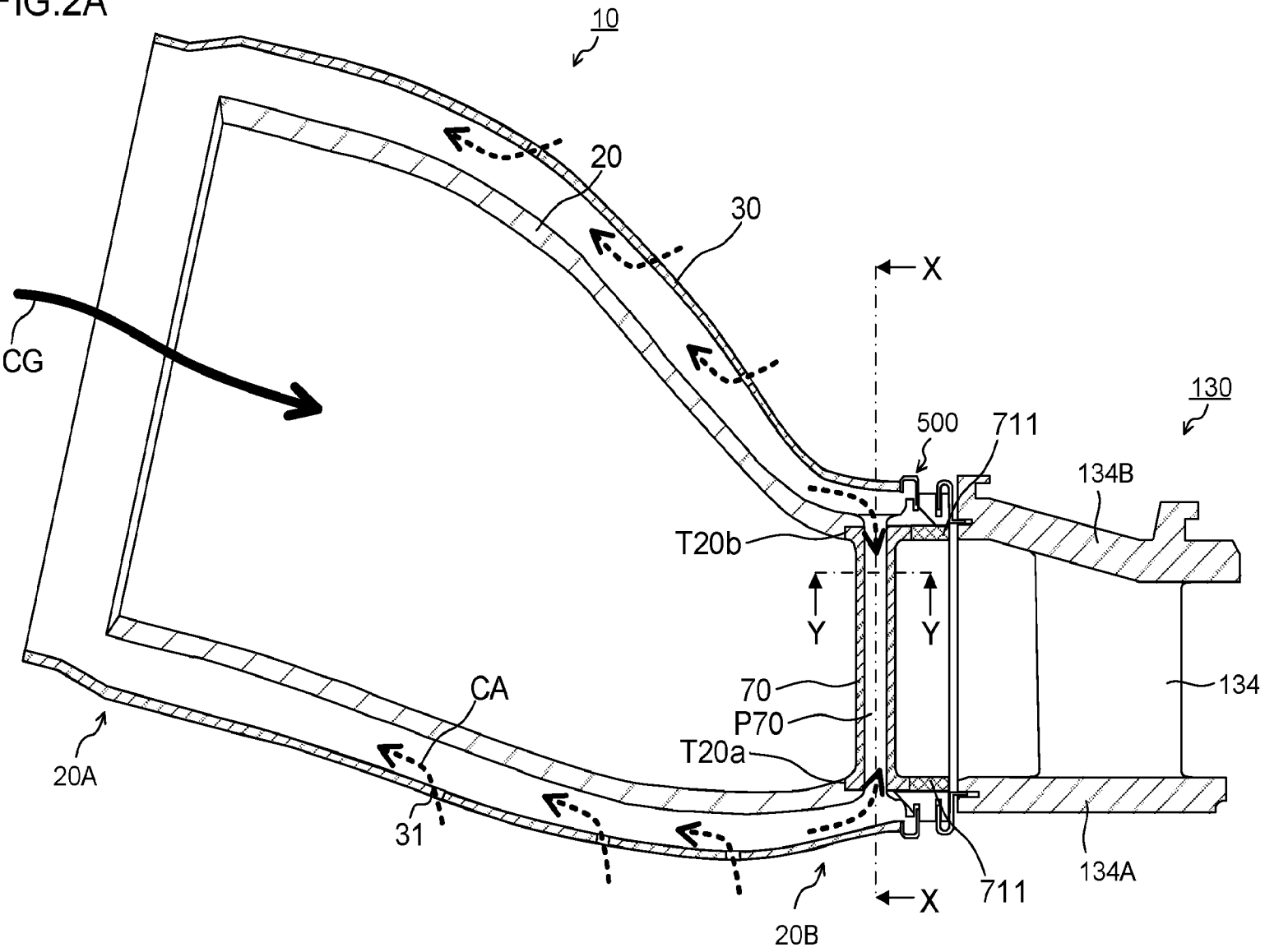
FIG. 2A is a sectional view schematically illustrating a transition piece part 10 in the gas turbine facility 100 according to the first embodiment.
Figure 2B:
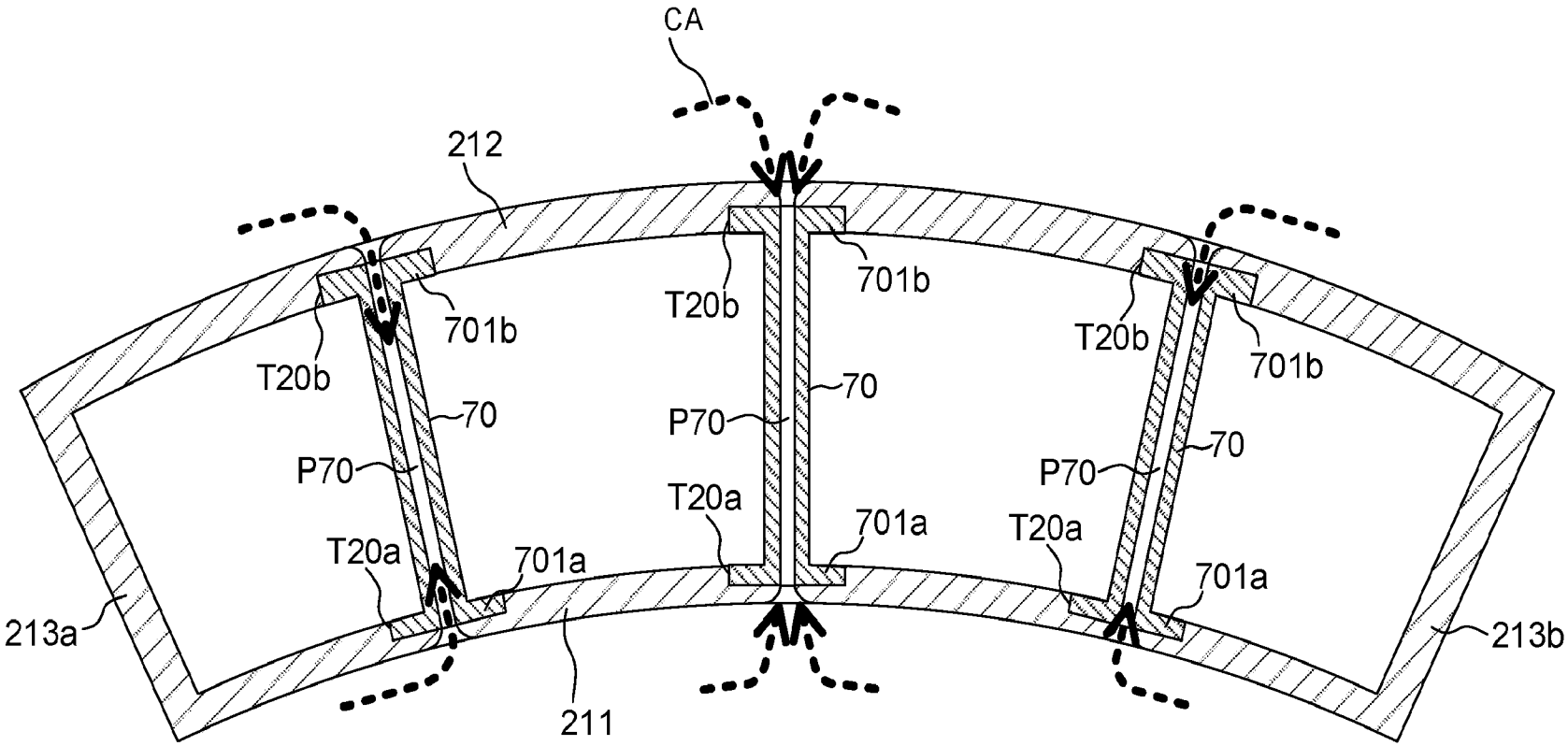
FIG. 2B is a sectional view schematically illustrating the transition piece part 10 in the gas turbine facility 100 according to the first embodiment.
Figure 2C:
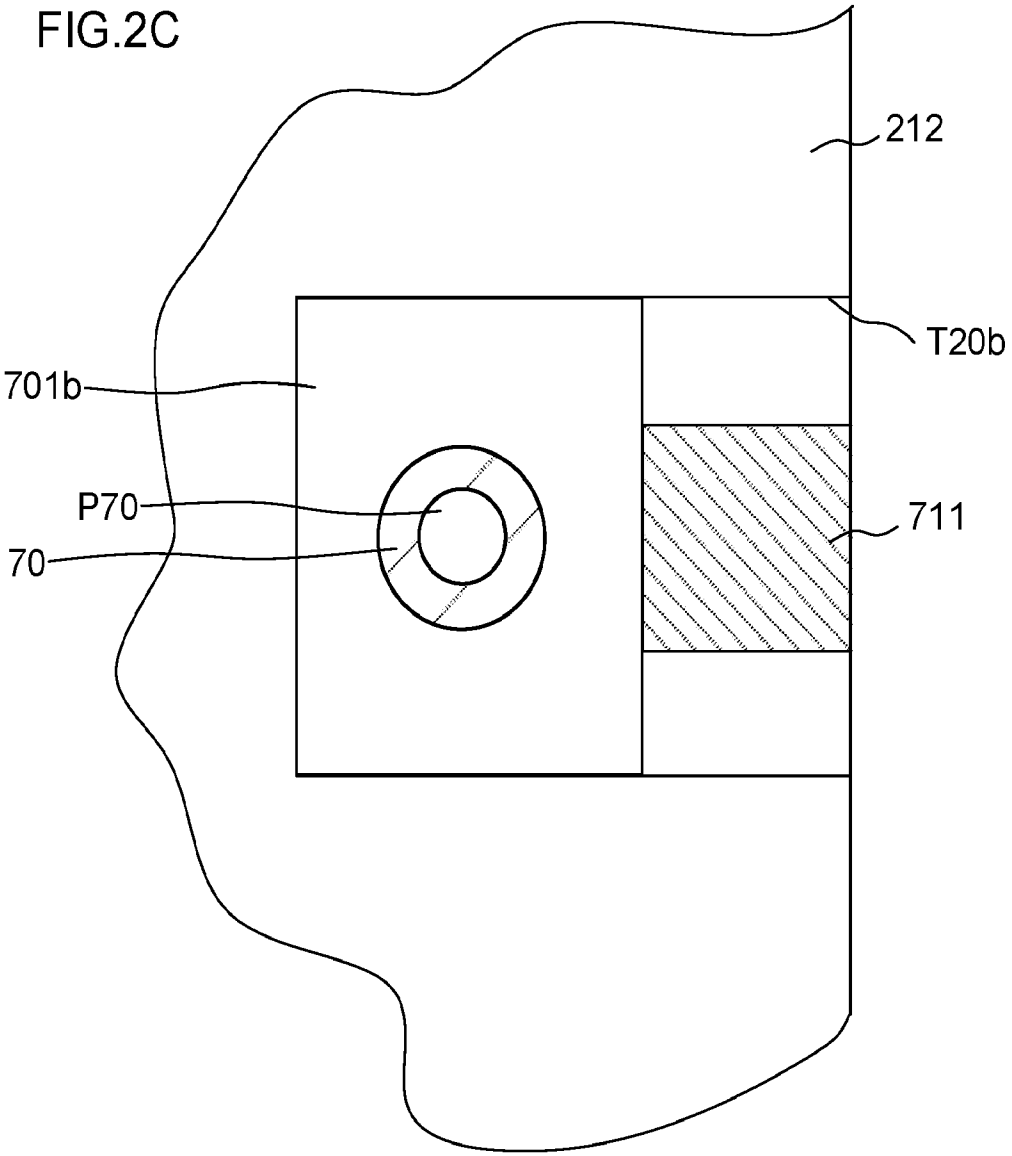
FIG. 2C is a sectional view schematically illustrating the transition piece part 10 in the gas turbine facility 100 according to the first embodiment.

Details on the transition piece part 10 will be explained by using FIG. 2A, FIG. 2B, and FIG. 2C. In FIG. 2A, a lateral direction corresponds to the axial direction, and a vertical direction corresponds to a part of the radial direction. FIG. 2B illustrates a cross section of an X-X portion illustrated in FIG. 2A, and a direction perpendicular to the sheet plane of FIG. 2B corresponds to the axial direction. FIG. 2C illustrates a cross section of a Y-Y portion illustrated in FIG. 2A, a direction perpendicular to the sheet plane of FIG. 2C corresponds to a part of the radial direction, and a lateral direction corresponds to the axial direction, and a vertical direction corresponds to the circumferential direction.

As illustrated in FIG. 2A, the transition piece part 10 includes a transition piece 20 (inner cylinder), and an outer cylinder 30 disposed so as to house the transition piece 20 inside. That is, the transition piece part 10 has a double-pipe structure. The transition piece part 10 is coupled to the turbine part 130 with a coupling member 500 interposed therebetween. Specifically, the transition piece part 10 is coupled to each of a diaphragm inner ring 134A and a diaphragm outer ring 134B sandwiching the stationary blade 134 in a first turbine stage.

In the transition piece part 10, the transition piece 20 is provided to direct a combustion gas CG which has flowed from the combustor liner 120 into the transition piece 20 to the turbine part 130.

Here, the transition piece 20 is constructed so that a cross section of a flow path through which the combustion gas CG flows is gradually transformed from a circular shape into a fan shape from the inlet toward the outlet. That is, although an illustration is omitted, in the transition piece 20, the inlet portion into which the combustion gas CG flows is a cylindrical tubular body, and is provided with a circular opening. In contrast with this, in the transition piece 20, the outlet portion from which the combustion gas CG flows out is a fan-shaped tubular body.

Specifically, in the outlet portion of the transition piece 20, as illustrated in FIG. 2B, an arc-shaped inner peripheral wall 211 and an arc-shaped outer peripheral wall 212 face each other in a radial direction with a gap (opening) interposed therebetween. Further, the outlet portion of the transition piece 20 includes a pair of sidewalls 213*a* and 213*b* along the radial direction, and the pair of sidewalls 213*a* and 213*b* face each other at both ends in a circumferential direction with the gap (opening) interposed therebetween.

In the outlet portion of the transition piece 20, the inner peripheral wall 211 is located inside in the radial direction of the turbine part 130, and in a surface located on the outer peripheral wall 212 side in the inner peripheral wall 211, first insertion grooves T20*a* are formed. Then, the outer peripheral wall 212 is located further outside than the inner peripheral wall 211 in the radial direction, and in a surface located on the inner peripheral wall 211 side in the outer peripheral wall 212, second insertion grooves T20*b* are formed.

The outer cylinder 30 is formed in a shape similar to that of the transition piece 20 being the inner cylinder. That is, the outer cylinder 30 is a cylindrical tubular body in the inlet portion, and a fan-shaped tubular body in the outlet portion.

As illustrated in FIG. 1 and FIG. 2A, in the outer cylinder 30, a plurality of ejection holes 31 are formed. The plurality of ejection holes 31 are provided, for example, to eject a part of air which flows from the compressor 110 into the outer cylinder 30 as a cooling medium CA toward an outer surface of the transition piece 20.

In this embodiment, the transition piece part 10 further includes a plurality of support struts 70. As illustrated in FIG. 2B, the plurality of support struts 70 are provided in the gap located between the inner peripheral wall 211 and the outer peripheral wall 212 in the outlet portion of the transition piece 20. Here, for example, the three support struts 70 are disposed to be spaced in the circumferential direction. Specifically, in the outlet portion of the transition piece 20, the support strut 70 is disposed in the middle portion in the circumferential direction, and a pair of support struts 70 are disposed at both side portions so as to sandwich the support strut 70 in the middle portion therein in the circumferential direction. The pair of support struts 70 disposed at both the side portions are symmetrically disposed in the circumferential direction with the support strut 70 in the middle portion being an axis.

The plurality of support struts 70 are, for example, each a cylindrical-shaped tubular body and each extend along the radial direction. In each of the plurality of support struts 70, a first fixed plate portion 701*a* is provided at one end (first end portion) located inside in the radial direction, and a second fixed plate portion 701*b* is provided at the other end (second end portion) located outside in the radial direction. The first fixed plate portion 701*a* and the second fixed plate portion 701*b* are each a rectangular plate-shaped body. In one ends located inside in the radial direction in the support struts 70, the first fixed plate portions 701*a* are inserted into and fixed in the first insertion grooves T20*a*. In the other ends located outside in the radial direction in the support struts 70, the second fixed plate portions 701*b* are inserted into and fixed in the second insertion grooves T20*b*.

Specifically, as illustrated in FIG. 2C, the second insertion groove T20*b* houses a block 711 with the second fixed plate portion 701*b*. A longitudinal direction of the second insertion groove T20*b* is along a flow direction (axial direction) of the combustion gas CG, the second fixed plate portion 701*b* is located on the inlet side of the combustion gas CG, and the block 711 is located on the outlet side of the combustion gas CG. A width in the circumferential direction (the vertical direction in FIG. 2C) in the second insertion groove T20*b* coincides with a width in the circumferential direction of the second fixed plate portion 701*b*. Then, a width in the axial direction (the lateral direction in FIG. 2C) in the second insertion groove T20*b* coincides with a total value of a width in the circumferential direction of the second fixed plate portion 701*b* and a width in the circumferential direction of the block 711. Although an enlarged view of the first insertion groove T20*a* is omitted, it is similar to that of the second insertion groove T20*b*.

When the support struts 70 are attached to the transition piece 20, the first fixed plate portions 701*a* are inserted into the first insertion grooves T20*a*, and the second fixed plate portions 701*b* are inserted into the second insertion grooves T20*b*. Thereafter, the blocks 711 are inserted into the respective first insertion grooves T20*a* and second insertion grooves T20*b*. This causes the support struts 70 to be fixed in the transition piece 20.

Further, the support struts 70 are provided so that cooling flow paths P70 through which the cooling medium CA flows pass therethrough in the radial direction.

Figure 3A:
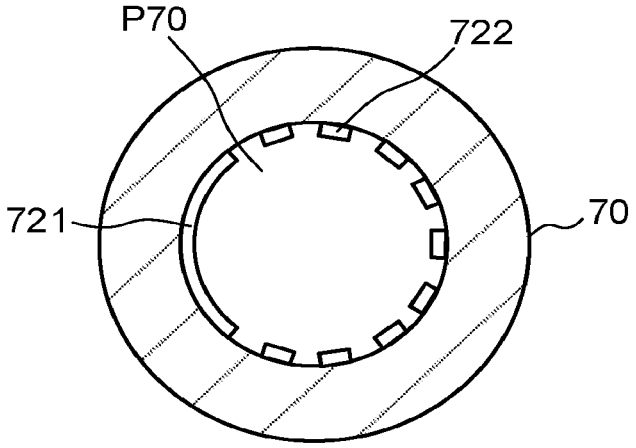
FIG. 3A is a sectional view enlarging and illustrating a support strut 70 in the gas turbine facility 100 according to the first embodiment.
Figure 3B:
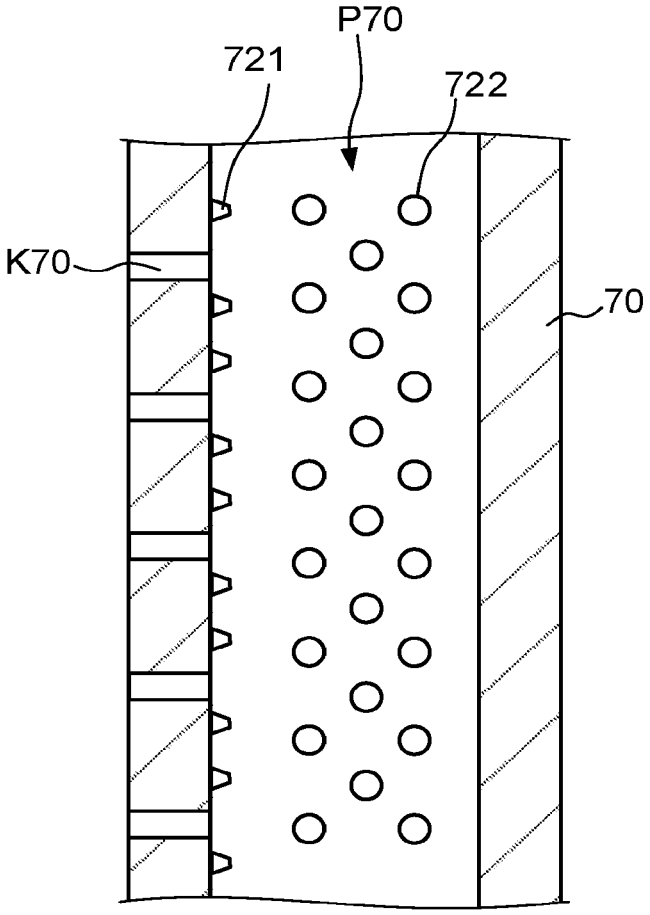
FIG. 3B is a sectional view enlarging and illustrating the support strut 70 in the gas turbine facility 100 according to the first embodiment.

The cooling flow path P70 of the support strut 70 will be explained by using FIG. 3A and FIG. 3B. In FIG. 3A, a lateral direction corresponds to the axial direction, and a direction perpendicular to the sheet plane of FIG. 3A corresponds to the radial direction. In FIG. 3B, a lateral direction corresponds to the axial direction, and a vertical direction corresponds to the radial direction.

As illustrated in FIG. 3A and FIG. 3B, fins 721 and pins 722 are provided on an inner peripheral surface of the support strut 70 provided with the cooling flow path P70.

A plurality of fins 721 are provided on an inlet side (the right side in FIG. 3A and FIG. 3B) of the transition piece 20 in the inner peripheral surface of the support strut 70. The fins 721 are each an arc-shaped plate-shaped body, and a plurality of the fins 721 are spaced in the radial direction.

The pins 722 are provided more closely on an outlet side (the left side in FIG. 3A and FIG. 3B) of the transition piece 20 than the fins 721 in the inner peripheral surface of the support strut 70. The pins 722 are each a column-shaped rod-shaped body, and a plurality of the pins 722 are spaced in the radial direction and in the axial direction.

In addition to the above, axially through holes K70 are provided in the support strut 70. The axially through holes K70 are formed in a portion located on the inlet side of the transition piece 20 in the support strut 70, and pass therethrough in the axial direction. That is, the axially through holes K70 make the cooling flow path P70 provided inside the support strut 70 and the outside located on the inlet side of the transition piece 20 in the support strut 70 communicate with each other. A plurality of the axially through holes K70 are spaced in the radial direction. In the portion located on the inlet side of the transition piece 20 in the support strut 70, the axially through holes K70 are provided in portions other than portions provided with the fins 721.

The cooling medium CA flows from one end and the other end in the radial direction in the cooling flow path P70 of the support strut 70 into the cooling flow path P70. Inside the cooling flow path P70, because the fins 721 and the pins 722 cause turbulization to the cooling medium CA, the action of convection cooling is strengthened. Then, the cooling medium CA is discharged from the axially through holes K70 formed on the inlet side of the transition piece 20 in the support strut 70 inside the transition piece 20. For this reason, in the support strut 70, the inlet side where the temperature becomes higher than that on the outlet side is effectively cooled by the action of film cooling.

As described above, in the transition piece 20 of this embodiment, the outlet portion from which the combustion gas CG flows out to the turbine part 130 includes: the inner peripheral wall 211 located inside in the radial direction of the turbine part 130; the outer peripheral wall 212 located further outside than the inner peripheral wall 211 in the radial direction; and the support struts 70 provided between the inner peripheral wall 211 and the outer peripheral wall 212. Here, in the inner peripheral wall 211, the first insertion grooves T20*a* are formed, and in the outer peripheral wall 212, the second insertion grooves T20*b* are formed. Then, in the support struts 70, one end portions are inserted into and fixed in the first insertion grooves T20*a*, and the other end portions are inserted into and fixed in the second insertion grooves T20*b*. The support struts 70 are not joined to the transition piece 20 by welding.

Accordingly, in the transition piece 20 of this embodiment, it is possible to suppress generation of a large thermal stress at the fixed positions of the support struts 70. Further, in this embodiment, it is possible to easily achieve the exchange of the support struts 70.

In addition, in this embodiment, the plurality of support struts 70 are installed in the transition piece 20. This makes it possible to effectively prevent the transition piece 20 from being deformed due to a differential pressure between the inside and the outside of the transition piece 20.

Figure 4:
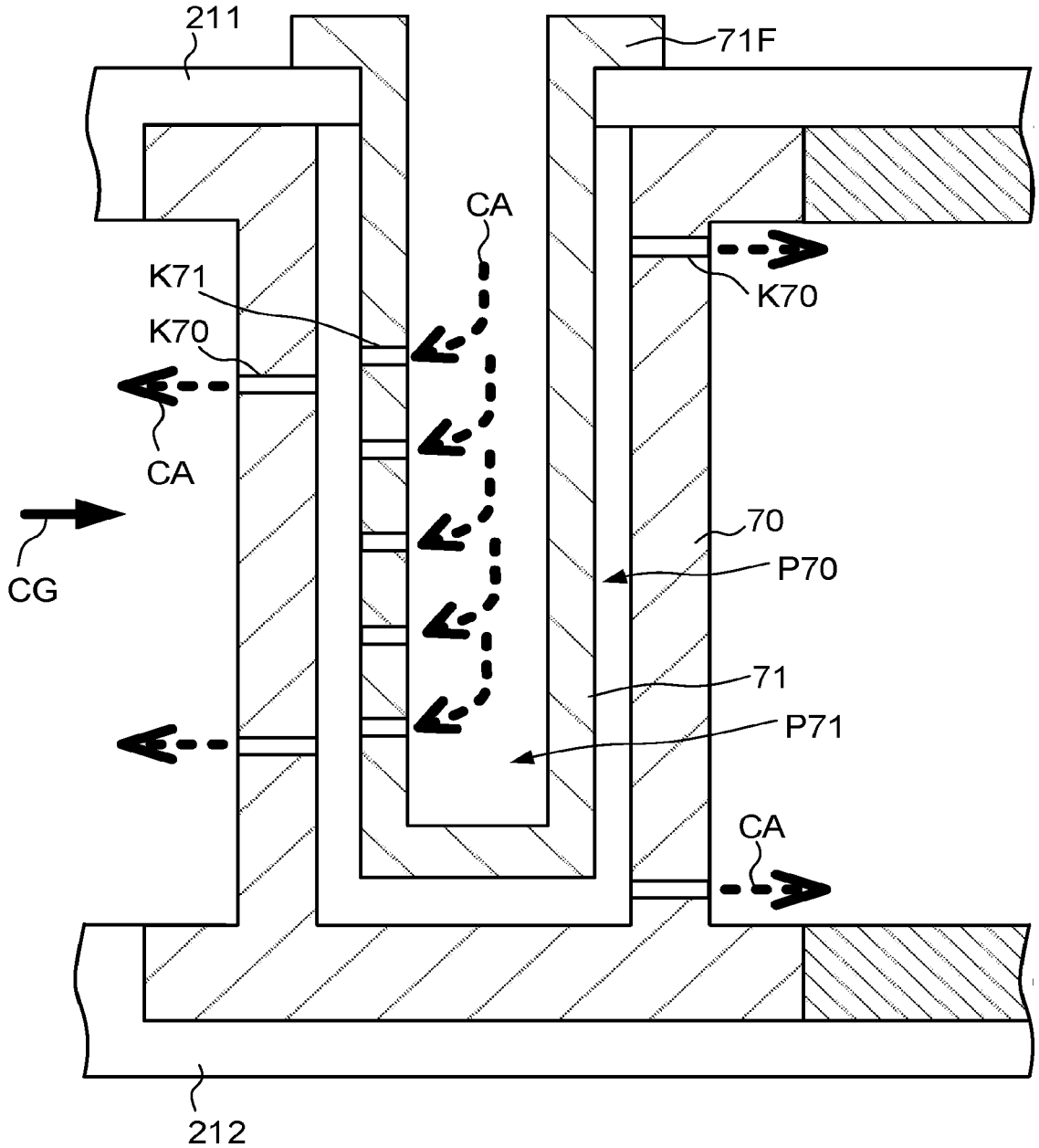
FIG. 4 is a view schematically illustrating a support strut 70 according to a modified example of the first embodiment.

A modified example of the support strut 70 will be explained by using FIG. 4. In FIG. 4, similarly to FIG. 2A, a lateral direction corresponds to the axial direction, and a vertical direction corresponds to a part of the radial direction.

As in the modified example illustrated in FIG. 4, the support strut 70 is further preferably constructed so that impinge cooling is performed. In this modified example, in the support strut 70, the cooling flow path P70 extends in the radial direction, but does not pass therethrough. In the support strut 70, the cooling flow path P70 is in a state in which the other end portion located outside in the radial direction is open but one end portion located inside in the radial direction is close. On the inlet side and the outlet side of the transition piece 20 in the support strut 70, the axially through holes K70 are formed. Specifically, on each of the inlet side (the left side in FIG. 4) and the outlet side (the right side) of the transition piece 20, for example, the two axially through holes K70 are spaced in the radial direction. The two axially through holes K70 provided on the inlet side of the transition piece 20 are provided so as to be sandwiched in the radial direction by the two axially through holes K70 provided on the outlet side of the transition piece 20. Then, into the inside which functions as the cooling flow path P70 in the support strut 70, an insert member 71 is inserted from the outside in the radial direction.

In this modified example, the insert member 71 is a cylindrical-shaped tubular body. An outer diameter of the insert member 71 is smaller than an inner diameter of the support strut 70, and a gap is interposed between an outer peripheral surface of the insert member 71 and the inner peripheral surface of the support strut 70. Further, in the insert member 71, at the other end portion located outside in the radial direction, a flange 71F is provided. The flange 71F of the insert member 71 is supported by a surface located outside in the radial direction in the inner peripheral wall 211 of the transition piece 20. In the insert member 71, similarly to the support strut 70, a cooling flow path P71 extends in the radial direction, but does not pass therethrough. In the insert member 71, the cooling flow path P71 is in a state in which the other end portion located outside in the radial direction is open, but in a state in which one end portion located inside in the radial direction is close. Axially through holes K71 are provided in the insert member 71. The axially through holes K71 are formed in a portion located on the inlet side of the transition piece 20 in the insert member 71, and pass therethrough in the axial direction. A plurality of the axially through holes K71 are spaced in the radial direction.

In this modified example, the cooling medium CA flows from an opening located outside in the radial direction in the cooling flow path P71 of the insert member 71 into the cooling flow path P71. The cooling medium CA is discharged from the axially through holes K71 formed on the inlet side of the transition piece 20 in the insert member 71 to the cooling flow path P70 of the support strut 70, thereby cooling the support strut 70. Thereafter, the cooling medium CA flows through the axially through holes K70 provided on the inlet side and the outlet side of the transition piece 20 in the cooling flow path P70 of the support strut 70, thereby cooling the support strut 70. Thus, by performing the impinge cooling with the film cooling, the support strut 70 may be cooled.

Note that in the above-described embodiment, a case where the support strut 70 has a cylindrical shape has been exemplified, but this is not restrictive. In order to suppress the inhibition of flow of the combustion gas CG due to the support strut 70, for example, an outer shape of the support strut 70 may be formed in a streamlined shape.

In addition to the above, in the above-described embodiment, a case where a plurality of the support struts 70 are installed in the transition piece 20 has been explained, but this is not restrictive. The single support strut 70 may be installed in the transition piece 20.

Second Embodiment

Figure 5:
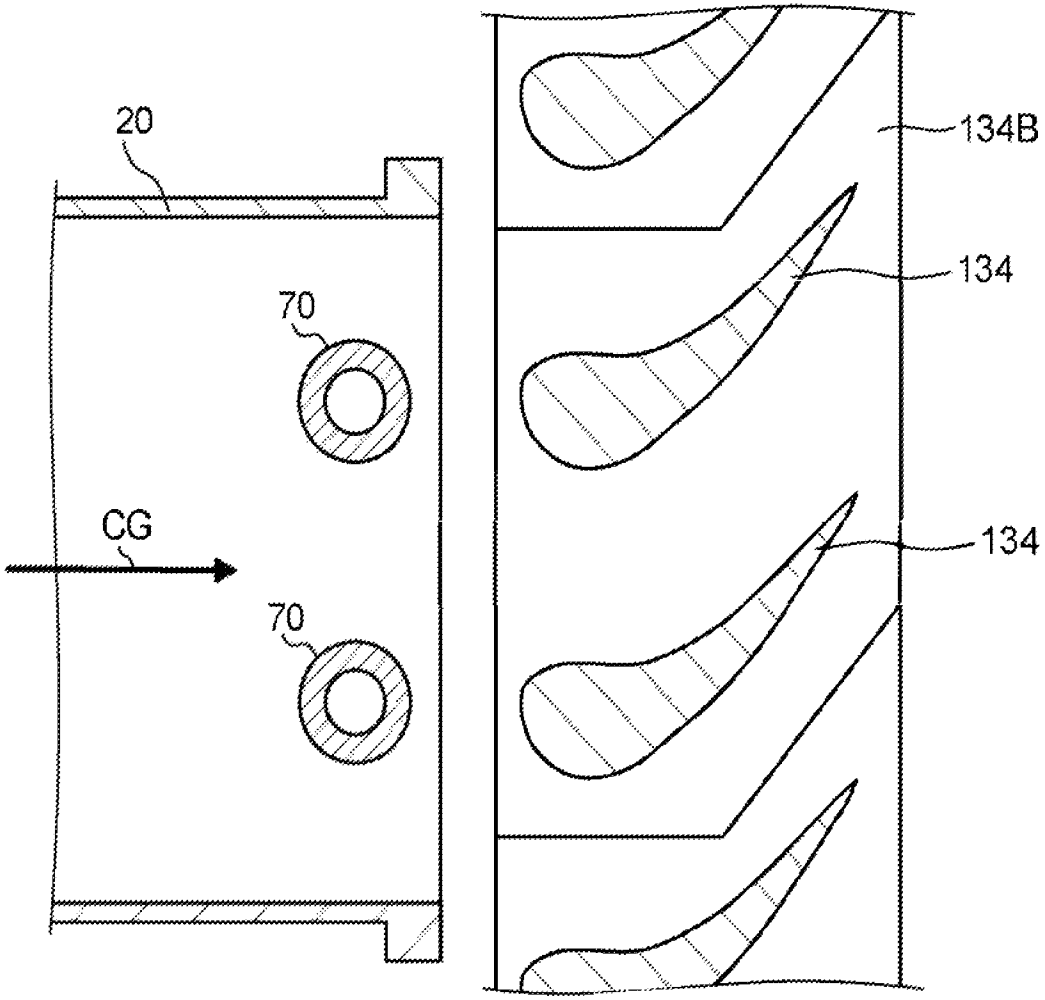
FIG. 5 is a view schematically enlarging and illustrating a portion where a transition piece 20 is installed in a gas turbine facility 100 according to a second embodiment.
Figure 6:
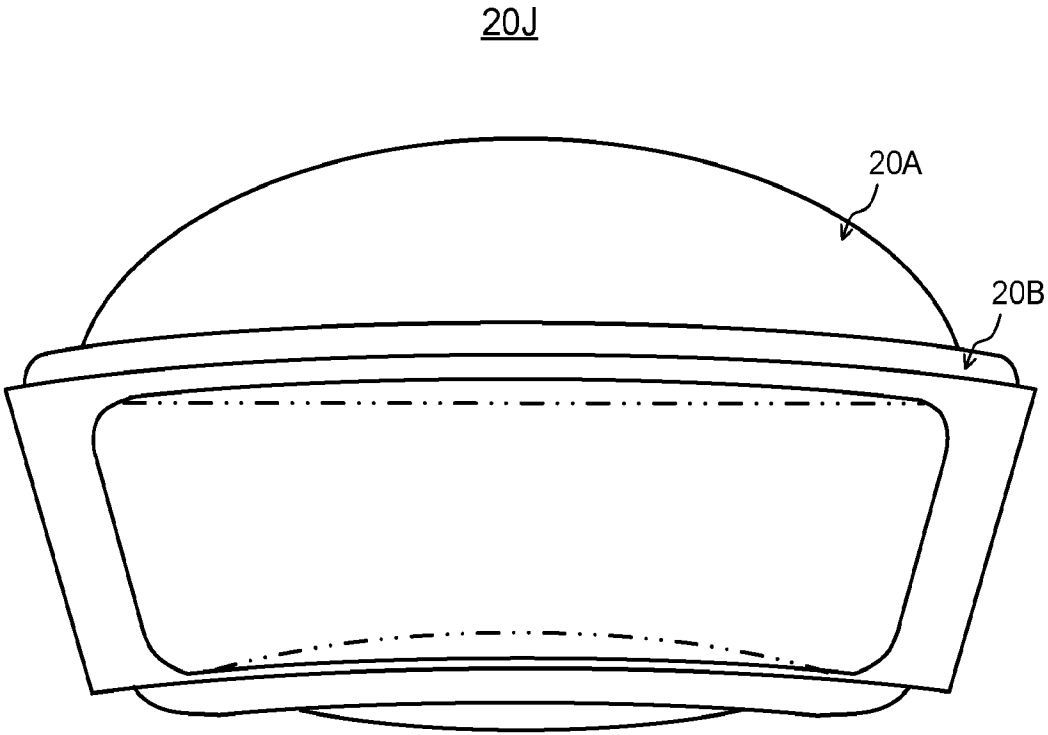
FIG.6 Related Art
FIG. 6 is a view illustrating a substantial part of a transition piece according to a related art.

Details on a transition piece 20 according to a second embodiment will be explained by using FIG. 5. FIG. 5 illustrates a disposition relationship between support struts 70 of the transition piece 20 and stationary blades 134 constituting a first turbine stage in a turbine part 130, and a vertical direction corresponds to a circumferential direction, a lateral direction corresponds to an axial direction, and a direction perpendicular to the sheet plane of FIG. 5 corresponds to a radial direction. In this embodiment, the same members as those of the above-described embodiment are denoted by the same reference signs, and an explanation of redundant portions is appropriately omitted.

As illustrated in FIG. 5, the respective plurality of support struts 70 are disposed so as to be located on a more upstream side than the respective leading edges of a plurality of the stationary blades 134 in the axial direction. That is, the support struts 70 and the leading edges of the stationary blades 134 are arranged along the axial direction.

In this embodiment, on an upstream side of a flow path through which a combustion gas CG flows as a wording medium between the plurality of stationary blades 134, the support strut 70 is not disposed. This makes it possible to reduce a flow loss of the combustion gas CG due to the support strut 70 in this embodiment.

Note that in this embodiment, a case where the number of support struts 70 and the number of stationary blades 134 are the same as each other has been exemplified, but this is not restrictive. The number of support struts 70 may be smaller than the number of stationary blades 134.

While certain embodiments of the present invention have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

EXPLANATION OF REFERENCE NUMERALS

10 . . . transition piece part, 20 . . . transition piece, 20A . . . inlet side, 20B . . . outlet side, 20J . . . transition piece, 30 . . . outer cylinder, 31 . . . ejection hole, 70 . . . support stmt, 721 . . . fin, 722 . . . pin, 71 insert member, 71F . . . flange, 100 . . . gas turbine facility, 110 . . . compressor, 111 . . . compressor casing, 112 . . . rotor blade, 113 . . . compressor rotor, 114 . . . stationary blade, 120 . . . combustor liner, 130 . . . turbine part, 131 . . . turbine casing, 132 . . . rotor blade, 133 . . . turbine rotor, 134 . . . stationary blade, 211 . . . inner peripheral wall, 212 . . . outer peripheral wall, 701*a* . . . first fixed plate portion, 701*b* . . . second fixed plate portion, 711 . . . block, CA . . . cooling medium, K70 . . . axially through hole, K71 . . . axially through hole, P70 . . . cooling flow path, P71 . . . cooling flow path, T20*a* . . . first insertion groove, T20*b* . . . second insertion groove.

What is claimed is:

1. A transition piece for leading a combustion gas to a turbine part in a gas turbine engine, the transition piece comprising:

an outlet portion from which the combustion gas flows out to the turbine part, wherein the outlet portion includes:

an inner peripheral wall;

an outer peripheral wall located radially outward of the inner peripheral wall; and a support strut provided between the inner peripheral wall and the outer peripheral wall, wherein the inner peripheral wall includes:

a first insertion groove that does not radially extend through the inner peripheral wall, and a first cooling medium inflow hole, wherein the outer peripheral wall includes:

a second insertion groove that does not radially extend through the outer peripheral wall, and a second cooling medium inflow hole, and wherein the support strut includes:

a first end portion inserted into and fixed in the first insertion groove;

a second end portion inserted into and fixed in the second insertion groove;

a cooling flow path extending radially through the support strut, the cooling flow path configured for a cooling medium to flow in from the first cooling medium inflow hole and the second cooling medium inflow hole; and an axial through hole configured to allow the cooling medium to be discharged from the cooling flow path and be mixed with the combustion gas.

2. The transition piece according to claim 1, wherein the support strut is disposed so as to be located upstream of a leading edge of a stationary blade constituting a first turbine stage.

* * * * *